US005762585A

United States Patent [19]

Jones et al.

[11] Patent Number: 5,762,585

[45] Date of Patent: *Jun. 9, 1998

[54] MACHINE AND METHOD FOR EXERCISING AND/OR TESTING MUSCLES

[75] Inventors: Arthur A. Jones, Ocala; Philip Sencil, Anthony, both of Fla.

[73] Assignee: MedX 96, Inc., Ocala, Fla.

[ * ] Notice: The term of this patent shall not extend beyond the expiration date of Pat. No. 5,002,269.

[21] Appl. No.: 769,133

[22] Filed: Dec. 18, 1996

Related U.S. Application Data

[63] Continuation-in-part of Ser. No. 723,643, Oct. 3, 1996, which is a continuation-in-part of Ser. No. 947,284, Sep. 15, 1992, Pat. No. 5,667,463, which is a continuation-in-part of Ser. No. 909,658, Jul. 7, 1992, Pat. No. 5,256,125, which is a continuation-in-part of Ser. No. 813,531, Dec. 26, 1991, Pat. No. 5,149,313, which is a continuation of Ser. No. 637,618, Jan. 4, 1991, Pat. No. 5,092,590, Division of Ser. No. 422,905, Oct. 18, 1989, Pat. No. 5,005,830, Division of Ser. No. 236,367, Aug. 25, 1988, Pat. No. 4,902,009, which is a continuation-in-part of Ser. No. 60,679, Jun. 11, 1987, Pat. No. 4,836,536, and a continuation-in-part of Ser. No. 181,372, Apr. 14, 1988, Pat. No. 4,834,365.

[51] Int. Cl.[6] ..... A63B 21/00

[52] U.S. Cl. ..... 482/8; 482/97; 482/100; 482/137

[58] Field of Search ..... 482/94, 97, 98–103, 482/133, 135–138, 908; 402/8, 9, 97, 99, 100, 137, 138, 900; 73/379.01

[56] References Cited

U.S. PATENT DOCUMENTS

| | | | |
|---|---|---|---|
| 167,137 | 1/1875 | Tiebout | 482/97 |
| 458,382 | 8/1891 | Zander | 482/97 |
| 684,688 | 10/1901 | Herz | 482/97 |
| 3,364,747 | 1/1968 | Ebstein | 482/97 X |
| 4,691,694 | 9/1987 | Boyd et al. | 482/8 X |
| 5,135,452 | 8/1992 | Jones | 482/99 |
| 5,421,796 | 6/1995 | Jones et al. | 482/100 |
| 5,624,353 | 4/1997 | Naidus | 482/97 X |

*Primary Examiner*—Richard J. Apley
*Assistant Examiner*—John Mulcahy
*Attorney, Agent, or Firm*—William E. Mouzavires

[57] ABSTRACT

An exercise machine or apparatus having a movement arm to be moved upon exertion of a body part against a resistance including a weight that pivots about an axis as the movement arm is moved by the exerciser. To change the resistive force imposed by the weight, the weight is moved relative to its pivotal axis to thereby increase or decrease the effective resistive force. The movement arm is operatively connected to the resistance by a cam connected to the movement arm and engaged with a follower which in turn is connected to the weight to pivot the weight about its pivotal axis. The cam is operatively connected to the movement arm by a strain gauge and a releasable lock mechanism.

9 Claims, 6 Drawing Sheets

MACHINE AND METHOD FOR EXERCISING AND/OR TESTING MUSCLES

RELATED APPLICATION

This application is a continuation-in-part of our prior co-pending application, Ser. No. 08/723,643, filed Oct. 3, 1996, entitled MACHINE AND METHOD FOR EXERCISING MUSCLES OF THE HUMAN BODY, which is a continuation-in-part of application, Ser. No. 07/947,284, filed Sep. 15, 1992 entitled EXERCISE MACHINES AND METHODS, now U.S. Pat. No. 5,667,463 which is a continuation-in-part of prior application, Ser. No. 07/909,658, filed Jul. 7, 1992 entitled BICEPS CURL MACHINE, now U.S. Pat. No. 5,256,125 which is a continuation-in-part of prior application, Ser. No. 07/813,531, now U.S. Pat. No. 5,149,313 filed Dec. 26, 1991, which is a continuation of prior application, Ser. No. 07/637,618 filed Jan. 4, 1991, now U.S. Pat. No. 5,092,590, which is a division of prior application, Ser. No. 07/422,905 filed Oct. 18, 1989, now U.S. Pat. No. 5,005,830 which in turn is a division of prior application, Ser. No. 07/236,367 filed Aug. 25, 1988, now U.S. Pat. No. 4,902,009, entitled MACHINE FOR EXERCISING AND/OR TESTING MUSCLES OF THE LOWER TRUNK, AND METHOD which in turn is a continuation-in-part of prior U.S. patent application, Ser. No. 07/060,679, filed Jun. 11, 1987, now U.S. Pat. No. 4,836,536 and Ser. No. 07/181,372, filed Apr. 14, 1988, now U.S. Pat. No. 4,834,365 and entitled COMPOUND WEIGHT SYSTEM. The disclosures of my above-identified patent applications are hereby incorporated by reference in their entirety into the instant application as part hereof.

BACKGROUND OF INVENTION

The present invention generally relates to methods and apparatus or machines for exercising and/or testing muscles of the human body. Such methods and apparatus of the prior art utilize some sort of a resistance mechanism to provide a load opposing the muscles being tested or exercised. Typically the user's body part containing the muscles to be exercised is moved against what is termed here "a movement arm" to which is attached a resistance mechanism that opposes movement of the movement arm as the exerciser exerts the muscles to move the movement arm. Various types of resistances have been used in the prior art to oppose movement of the movement arm, such resistances including dead weights which can be either included in a weight stack or a free weight system where one or more weights is directly connected or mounted on the movement arm. Other resistances include devices such as, for example, braking systems or that disclosed in U.S. Pat. No. 3,465,592 to Perrine including a rotatable shaft with a speed control limiting the maximum weight of angular displacement of the shaft.

Weight stacks are known to possess certain advantages over other types of resistance devices such as those mentioned above. However due to their size, weight stacks have definite space requirements which increase the overall size of the exercise machine or apparatus. Although free weights are directly mounted to the movement arm rather than being selected from a weight stack, free weights also possess disadvantages in weight selection and they also can affect the stability of the exercise machine or apparatus.

As will be seen below, the present invention provides a novel and improved resistance apparatus or system for a muscle exercising or testing machine or apparatus which utilizes one or more dead weights and yet is free of the disadvantages which attend weight stacks or free weight resistance devices.

OBJECTS OF THE PRESENT INVENTION

It is an object of the present invention to provide novel and improved methods and apparatus for exercising and/or testing muscles of the human body.

A further object of the present invention is to provide novel and improved resistance mechanisms which may be utilized in new or old methods and apparatus for exercising the muscles and which also use one or more dead weights.

A further object of the present invention is to provide a novel and improved method and apparatus for exercising human muscles incorporating a novel and improved resistance mechanism for opposing exercise of the muscles. Incorporated herein is a provision of such a novel and improved resistance mechanism which may quickly and easily be adjusted to change the resistance force or torque imposed by the resistance mechanism in opposition to exercise of the muscles. Further included herein is a provision of such a resistance mechanism which does not require a weight stack or direct attachment of a resistance weight to a movement arm included in the exercise machine.

Another object of the present invention is to provide a novel and improved resistance methods and apparatus for exercise and/or testing machines which does not utilize cables and pulleys or conventional weight stacks.

SUMMARY OF PREFERRED EMBODIMENT OF THE PRESENT INVENTION

One preferred embodiment of the present invention includes a machine or apparatus having a movement arm to be moved upon exertion of a body part against a resistance including a weight that pivots about an axis as the movement arm is moved by the exerciser. To change the amount of resistance or resistive force imposed by the weight, the weight is moved relative to its pivotal axis to thereby increase or decrease the effective resistive force or moment provided by the weight when the movement arm is moved by the exerciser.

In one preferred embodiment, the movement arm is operatively connected to the resistance by a cam connected to the movement arm and engaged with a follower which in turn is connected to the weight to pivot the weight about its pivotal axis.

DRAWINGS

Other aspects of the invention including features and objects thereof are described in detail below in conjunction with the attached drawings in which.

DETAILED DESCRIPTION

Figure 1:
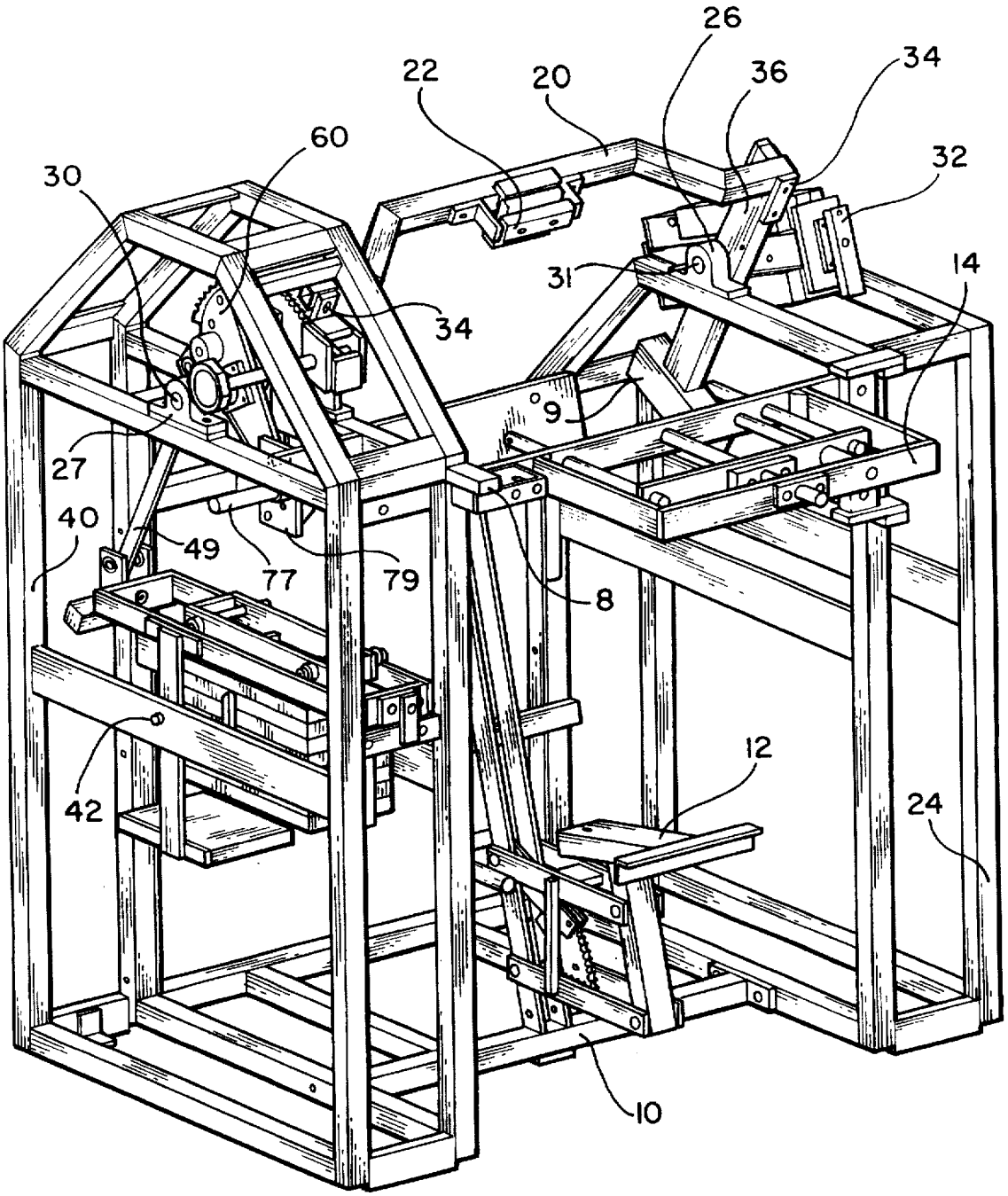
FIG. 1 is a perspective view of apparatus incorporating one preferred embodiment of the present invention for exercising muscles of the human body, however with certain parts removed for clarity.

Referring now to the drawings in detail, there is shown in FIG. 1 for illustrative purposes only, an apparatus or machine for exercising and/or testing muscles of the neck. Although the present invention is being illustrated in conjunction with a neck exercise machine, it will be understood after reviewing the description below, that the present invention may be applied to exercise and/or test muscles of the back such as the lumbar muscles, rotary torso muscles, leg muscles, etc. without departing from the present invention.

The disclosed apparatus includes a stationary frame constructed from elongated structural steel or alloy materials and including a central frame generally designated 10 on which is fixed a seat structure generally designated 12, it being understood that the seat pad and backrest pad are not shown in FIG. 1 for purposes of clarity. The height and angle of the seat and backrest may be adjusted as desired by an apparatus which forms no part of the present invention and need not be described.

Figure 3:
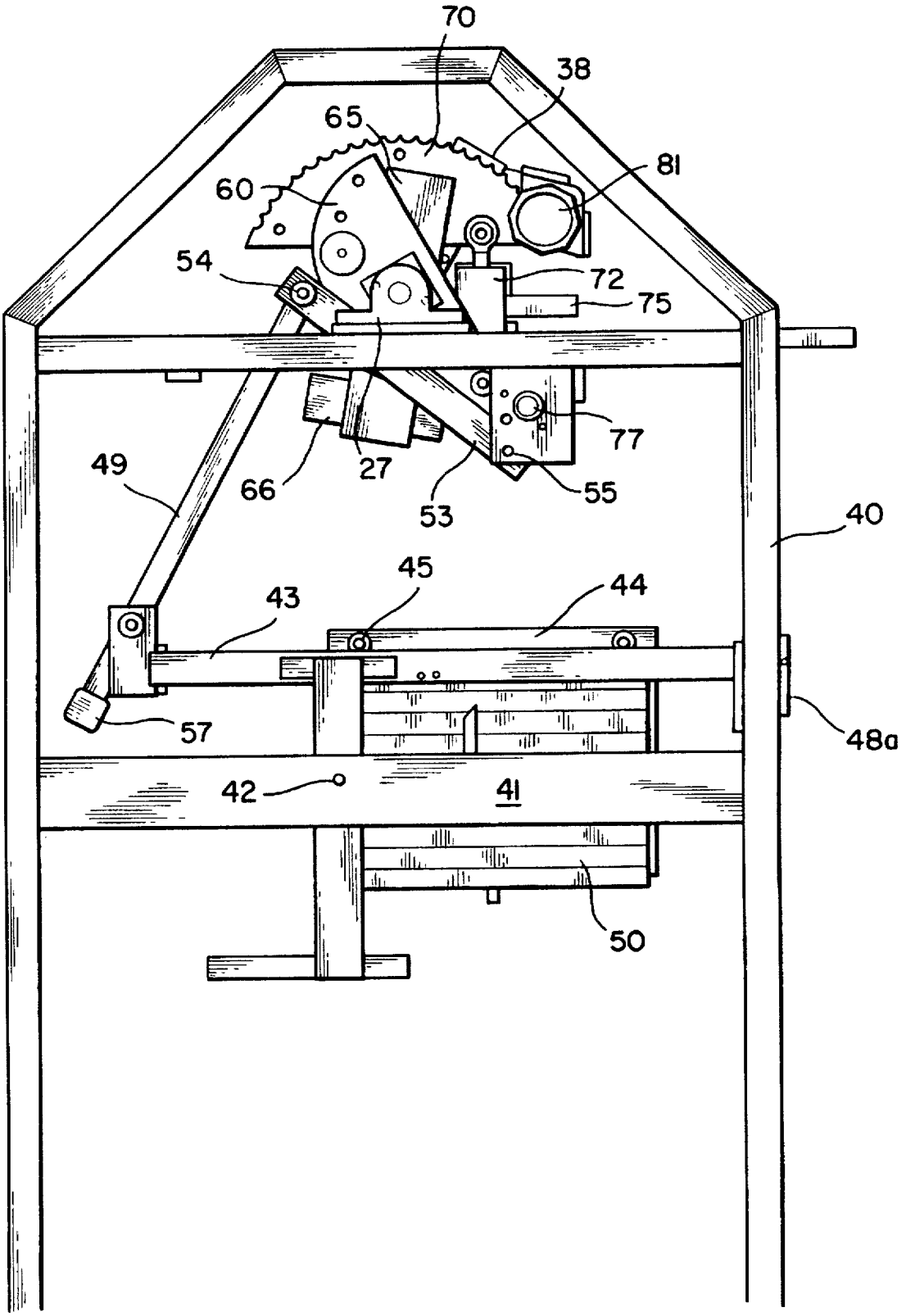
FIG. 3 is a side elevational view of the apparatus shown in FIG. 1 with certain parts removed.
Figure 4:
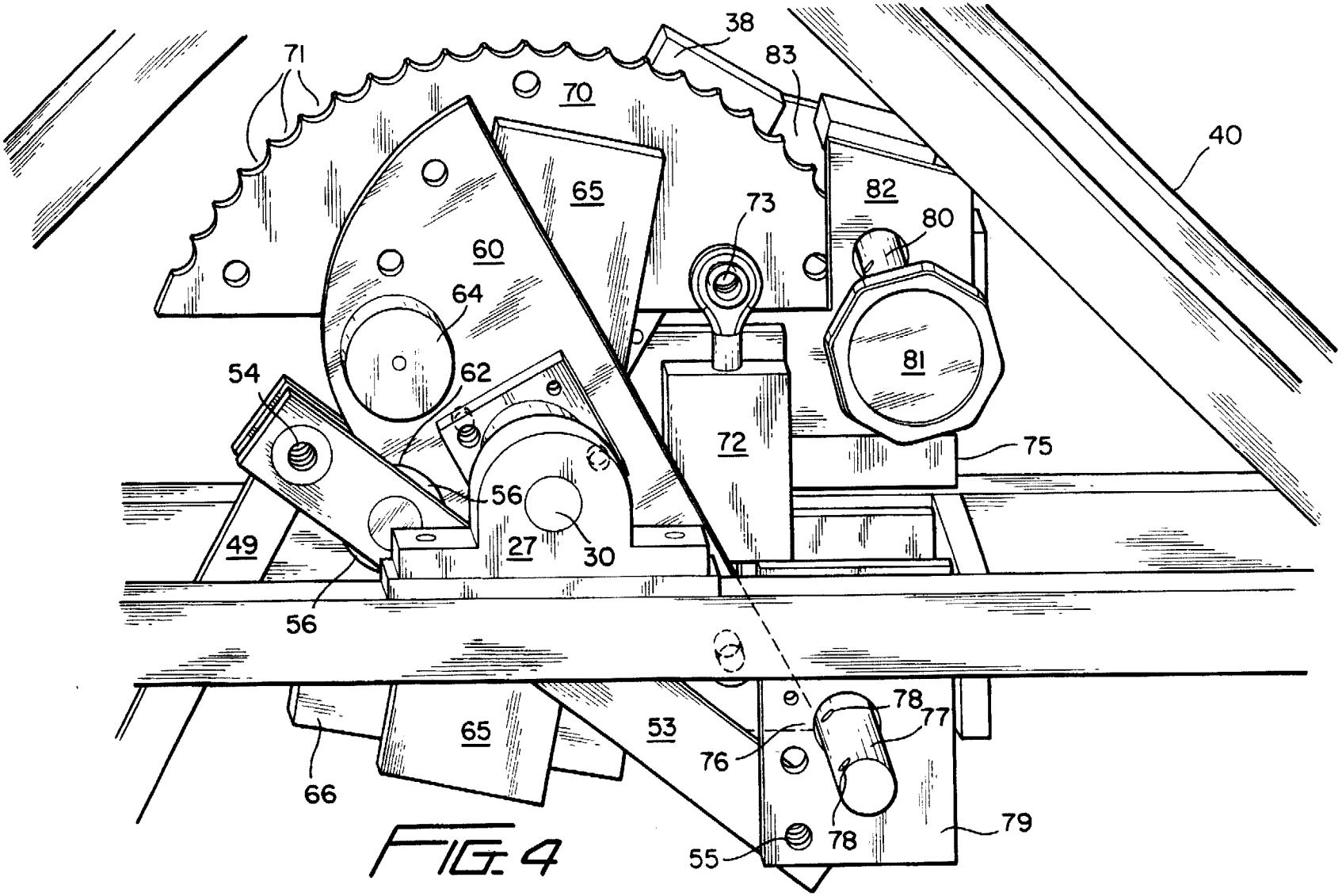
FIG. 4 is an enlarged perspective view of a portion of the apparatus including a cam, cam follower and lock mechanisms.
Figure 5:
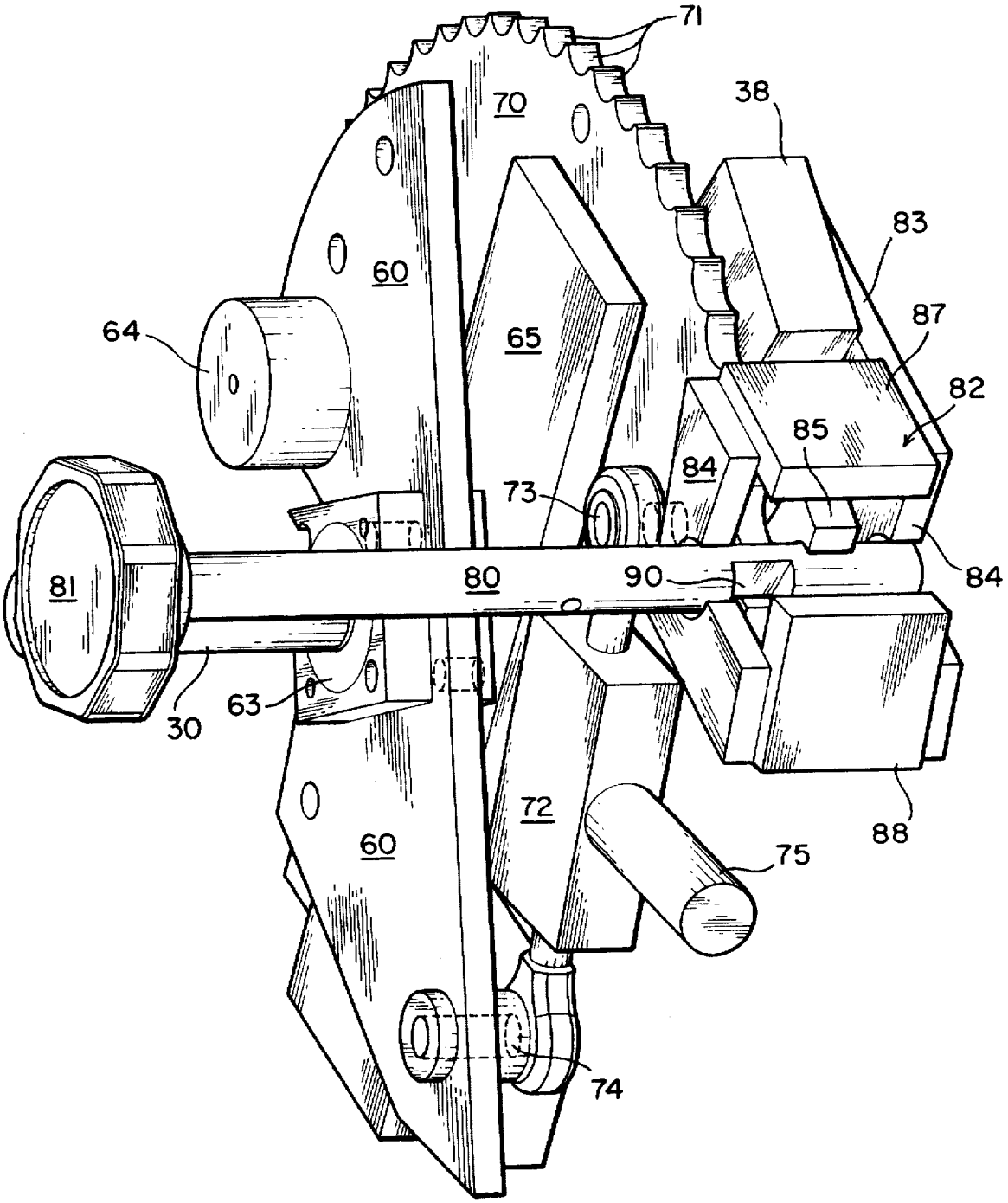
FIG. 5 is a perspective view of portions of the assembly shown in FIG. 4 and as seen from another perspective.

Exercise and/or testing of the neck muscles is effected by applying a force from the head rearwardly against a movement arm 20 to pivot the movement arm 20 about a generally horizontal axis shown by the shafts 30 and 31 held in bearings, one shown at 26 in the specific embodiment. A head pad (not shown) is mounted to the movement arm 20 via an assembly 22 to receive the back of the head. In the specific embodiment shown in FIGS. 1 and 7, the movement arm 20 includes a crosspiece or yoke and arms 38 and 36 fixed by straps 34 to opposite ends of the yoke. FIG. 1 shows arm 36 having oppositely extending shaft portions 31 mounted in bearing blocks 26 supported on side frame 24. The opposite arm 38 as shown in FIGS. 3 to 5, has shafts 30 mounted in blocks 27 fixed to the side frame generally designated 40. Movement arm 20 is counterweighted with respect to the axis which extends through shafts 30 and 31 by means of a counterweight 9 fixed to the lower end of arm 36 as shown in FIG. 1. In addition, a mechanism 32 is connected to the movement arm 20 at the left side thereof for counterbalancing the mass of the upper torso of the user of the machine.

Once the user is seated in the machine, his chest and shoulders are immobilized by a mechanism generally designated 14 in FIG. 1 which is hinged at 8 to the righthand frame section 40 for movement between a closed position shown in FIG. 1 and an open position allowing access to the machine. The mechanism 14 has one or more pads that engage the chest and upper shoulder area of the user to immobilize the torso during the exercise. A more detailed description of the mechanism 14 as well as the seat assembly 12, the movement arm 20, and the counterweight mechanisms may be obtained from U.S. Pat. No. 5,002,269 to Jones who is one of the Applicants in the present application. The entire disclosure of the aforementioned Jones U.S. Pat. No. 5,002,269 is hereby incorporated herein by reference as part hereof.

Figure 6:
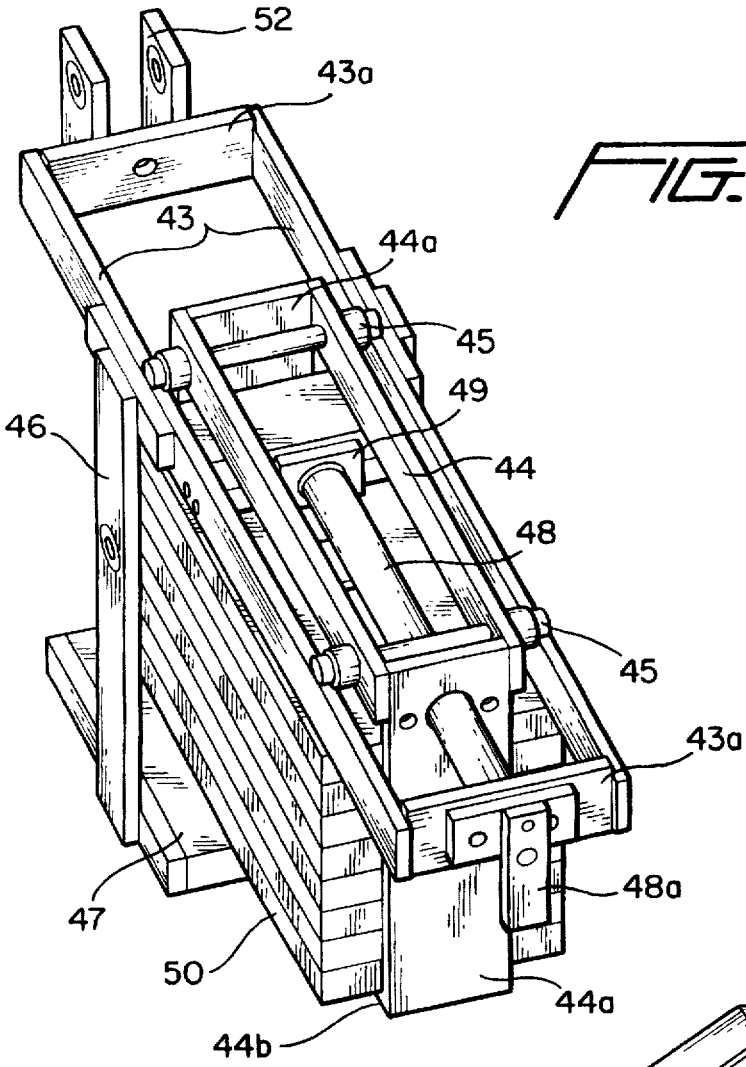
FIG. 6 is a perspective view of a resistance weight assembly incorporated in the apparatus described above.

When the user pivots the movement arm 20 rearwardly to rotate it about the horizontal axis coinciding with the axes of rotation of shafts 30 and 31, he does so against the opposition of a resistance mechanism which is provided in accordance with the present invention. This mechanism includes one or more dead weights 50 held in a carrier which in the preferred embodiment includes elongated side plates 44 and end plates **44*a* fixed to and between side plates 44 and depending therefrom to terminate at the lower ends in a bottom plate 44*b* as best shown in FIG. 6. Weights 50 are enclosed by the end and bottom plates 44*a* and 44*b* while the side plates 44 at the upper end are provided with rollers 45 to enable the weights to be moved horizontally as will be described further. The weight carrier 44, 44*a* which may also be termed the weight carriage, is mounted on top of a frame which in the shown embodiment includes opposite side rails 43 interconnected at their ends by end pieces 43*a* to form a generally rectangular structure. The rollers 45 of the weight carriage are mounted on the upper edges of rails 43 to be movable along the rails to adjust the resistive force or moment offered by the weights 50 as will be described. In the preferred embodiment, an elongated screw 48 is mounted to an aperture in the end wall 44*a* of the weight carriage with its end received in a threaded nut plate 49 fixed to the weight carrier between the opposite sides 44 thereof as best shown in FIG. 6. Screw 48 extends through an aperture in end plate 43*a* of the frame where it is provided with any suitable handle 48*a* by which it is rotated to move the weight carrier 44 along the screw 48 inasmuch as the nut 49 is held fixed to the weight carriage 44. Thus the position of the weights 50 may be moved horizontally relative to the frame 43** to adjust the resistive force offered as will become clear.

Figure 2:
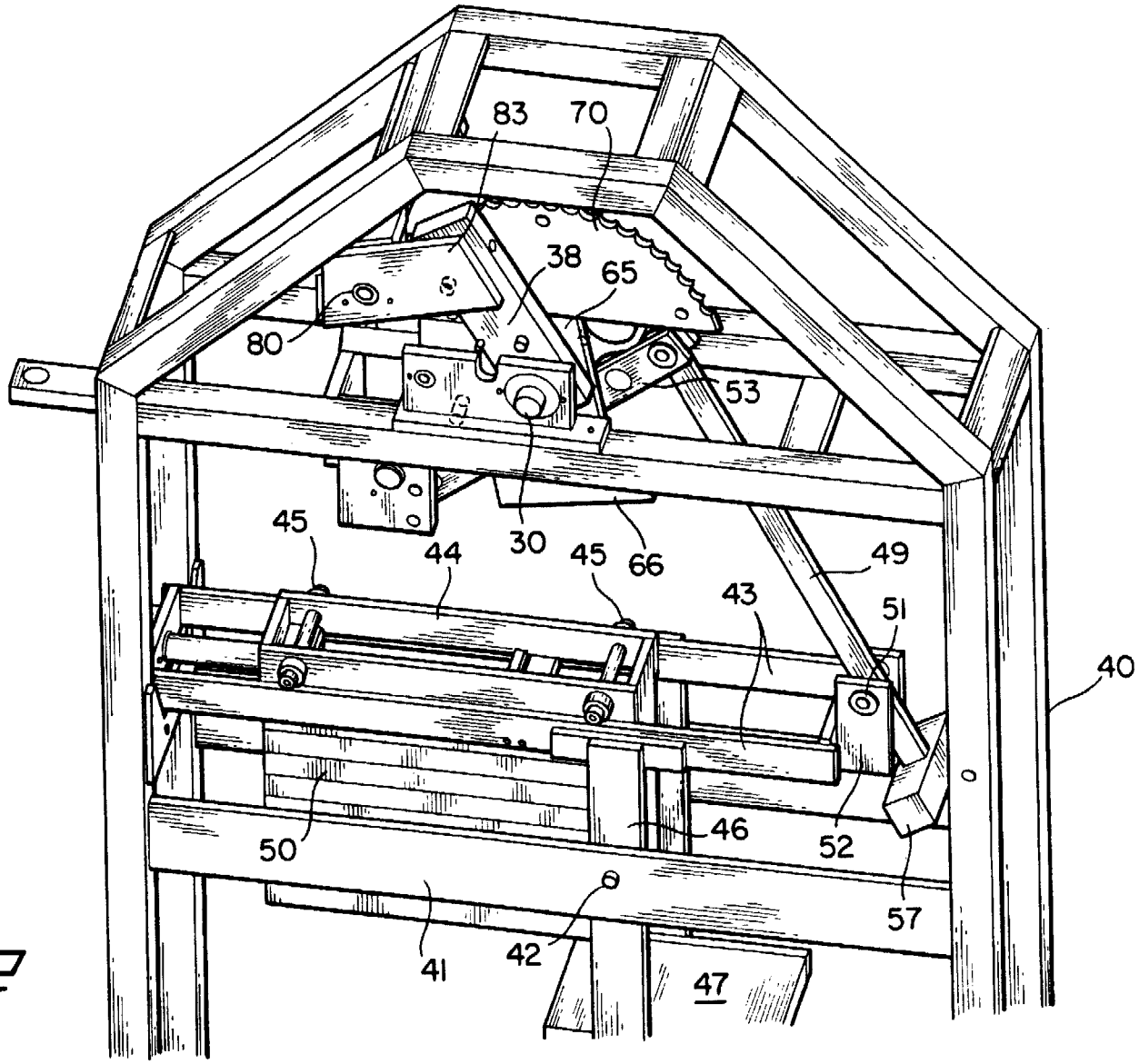
FIG. 2 is an enlarged perspective view of portions of the apparatus shown in FIG. 1 but seen from another angle.

The weights 50 and their carriage 44 are mounted for pivotal movement about an axis which in the shown embodiment is provided by the horizontal pivot pin 42 received in a portion 41 of the frame 40. When weights 50 are adjusted towards or away from the pivot axis 42, the resistive force or moment offered thereby to movement of the movement arm 20 will be changed accordingly. The closer the weights 50 to the pivot axis 42, the less resistive force they will apply. In the specific embodiment shown, the weight carriage is mounted through means of its frame 43 which is provided with opposite depending legs 46 fixed to and depending from frame sides 43. Pivot pins 42 are mounted through stationary frame portions 41 and legs 46 as best shown in FIG. 2. It is also preferred that the frame 43 be counterweighted which in the specific embodiment shown is affected through a weight plate 47 fixed to and between legs 46 of frame 43. It will thus be seen that in order to change the resistive force offered by the weights 50, all that is required is that the screw 48 be rotated to move the weights 50 horizontally towards or away from the pivot 42 to decrease or increase the resistive force. Although a series of weight plates 50 are utilized in the shown embodiment, a single large or small weight may be employed instead.

In the preferred embodiment, movement of the movement arm 20 is transmitted to the weights 50 to rotate them about pivot axis 42 by a transmission including a cam shown as a plate 60 mounted by suitable bearings or bushings 63 about shaft 30 for rotation about shaft 30. The peripheral surface of cam 60 is provided with a cam surface such as shown at 62 in FIG. 4 to engage a cam follower upon rotation of the cam 60 about shaft 30. In the specific embodiment shown, the cam follower includes a roll 56 mounted to a cam follower lever 53 which includes a pair of parallel links straddling the cam follower roll 56, the latter being mounted for rotation in the links. The lower end of cam follower lever 53 is pivotally mounted in a bracket 79 fixed to a portion of the stationary frame 40 while the opposite upper end of cam follower lever 53 is pivotally connected at 54 to a connecting link 49. As best shown in FIG. 2, the latter is connected to the resistance weight assembly by a pivot received in bracket 52 fixed to frame 43 of the resistance weight assembly. Preferably, the cam follower linkage is counterweighted by a weight 57 fixed to the lower end of connecting link 49 as shown in FIG. 2.

With reference to FIGS. 1 and 4, when cam 60 is rotated counterclockwise as viewed in FIGS. 1 and 4, the cam follower roll 56 will be engaged by the cam 60 and cam follower lever 63 will be depressed pivoting counterclockwise about the axis at 55 relative to the stationary frame. This will also cause the connecting link 49 to be depressed which in turn will cause the weight assembly to pivot about the axis at 42 against the opposition of the weights 50. When the user moves back to the starting position, the weights 50 will return to the horizontal position generally shown in FIG. 1 as the cam 60 rotates clockwise back to its starting position. If the user desires to change the magnitude of the resistance, he merely grasps handle 48 while seated and rotates it to move the weights 50 towards or away from the pivot axis 42. In the preferred embodiment shown, the cam 60 is counterweighted by suitable weight 64 fixed to the cam 60 so that the cam 60 is balanced relative to its pivotal axis through shaft 30.

In order to fix the position of the cam 60 to allow static strength tests to be obtained as will be described further, a lock mechanism is provided by which cam 60 may be locked against movement and released to permit movement about axis 30. In the specific embodiment shown, this is achieved through a rod 77 rotatably mounted in brackets 79 fixed to the stationary frame section 40 as best shown in FIGS. 1 and 4. When rotated into one position, rod 77 will be engageable with the edge of cam 60 shown at the general area 76 in FIG. 4 to prevent counterclockwise rotation as viewed in FIG. 4. In order to release the cam 60, rod 77 is rotated to another position at which a recess (not shown) formed in rod 77 is registered with the edge of the cam 60 to allow the cam 60 to rotate through the passage in the rod 77 without obstruction. A suitable handle (not shown) is fixed to the rod 77 by means of the apertures 78 to facilitate rotation.

Movement of the movement arm 20 is transmitted to the cam 60 during use of the machine by means of the arm 38 of the movement arm 20 which arm 38 in the specific embodiment shown is an elongated rectangular piece similar to arm 36 on the opposite side of the machine as described above. In the preferred embodiment, arm 38 is fixed by means of straps 34 shown in FIGS. 1 and 7 which are bolted to the end of the movement arm 20 and the sides of the adjoining arm 38. As shown in FIG. 2, arm 38 is rotatably mounted about shaft 30 through means including a releasable lock mechanism including what is termed herein "a latch plate" 70 mounted for rotation about shaft 30. This mounting is accomplished in the specific embodiment by means of a mounting arm 65 shown as having a generally rectangular shape with a counterweight 66 fixed at its bottom to balance the weight of the latch plate 70 and the arm 65 relative to the axis of shaft 30.

The movement arm 20, 38 is releasably connectable to the latch plate 70 to rotate the movement arm together with the latch plate by means including a locking member such as a cylindrical pin or rod 80 which when received in one of the notches or recesses 71 in the periphery of the latch plate 70, will connect the latter to the movement arm. FIG. 5 shows the position of the locking pin 80 where it connects the latch plate 70 to the movement arm 38. Locking pin 80 is provided with a recess 90 shown in FIG. 5 such that when the locking pin 80 is pushed inwardly to register the recess 90 with the periphery of latch plate 70, the locking pin 80 may then be rotated to position the recess 90 over the peripheral edge of locking plate 70 such that locking pin 80 will no longer engage latch plate 70 to thereby free the latch plate 70 and the movement arm for rotation. In the specific embodiment shown, locking pin 80 is mounted in passages formed in end plates 84 and a middle plate 85 of a receptacle generally designated 82, which also includes a top wall 87 and end wall 88 as best shown in FIG. 5. Receptacle 82 is fixed to movement arm piece 38 by a rigid strap in the form of a plate 83 extending between and welded to the arm 38 and receptacle 82, see also FIG. 2. Locking pin 80 is thus mounted for axial slidable movement as well as rotational movement in receptacle 82. A suitable handling knob 81 is fixed to the outer end of locking pin 81.

In order to transmit motion from movement arm 20,38 and latch plate 70 to cam 60, the latter is operatively connected to latch plate 70 by means of a link generally designated 72 which in the preferred embodiment shown also serves as a strain gauge for measuring forces and torque applied to the movement arm by the user. One end of the strain gauge is pivotally connected at 73 to the latch plate 70 while the opposite end is pivotally connected at 74 to the cam 60 as best shown in FIG. 5. Readings from the strain gauge 72 are fed into a computer through electrical connections housed in connector 75 projecting from the strain gauge as shown in FIG. 5.

The apparatus of the present invention may also be used to test and determine the static strength of the muscles. This is effected by fixing the position of the movement arm 20 so that it cannot rotate, and then having the subject apply a force against the movement arm by exerting the muscles to be tested. Forces will be measured by the strain gauge and sent to the computer and at the same time be displayed on a graph appearing on a monitor screen. Static strength of the subject is measured in different positions which are achieved by releasing the latch plate 70 from the locking pin 80, then rotating the movement arm into the desired position and then pushing and rotating the locking pin 80 to engage the latch plate 70 to lock it in the selected position. The process is repeated so that the static strength is measured in different angular positions of the user's body part. During the aforementioned testing of static strength, the cam 60 remains in locked position against movement by means of the locking pin 77 which engages the periphery of the cam in the area 76 as described above.

Figure 7:
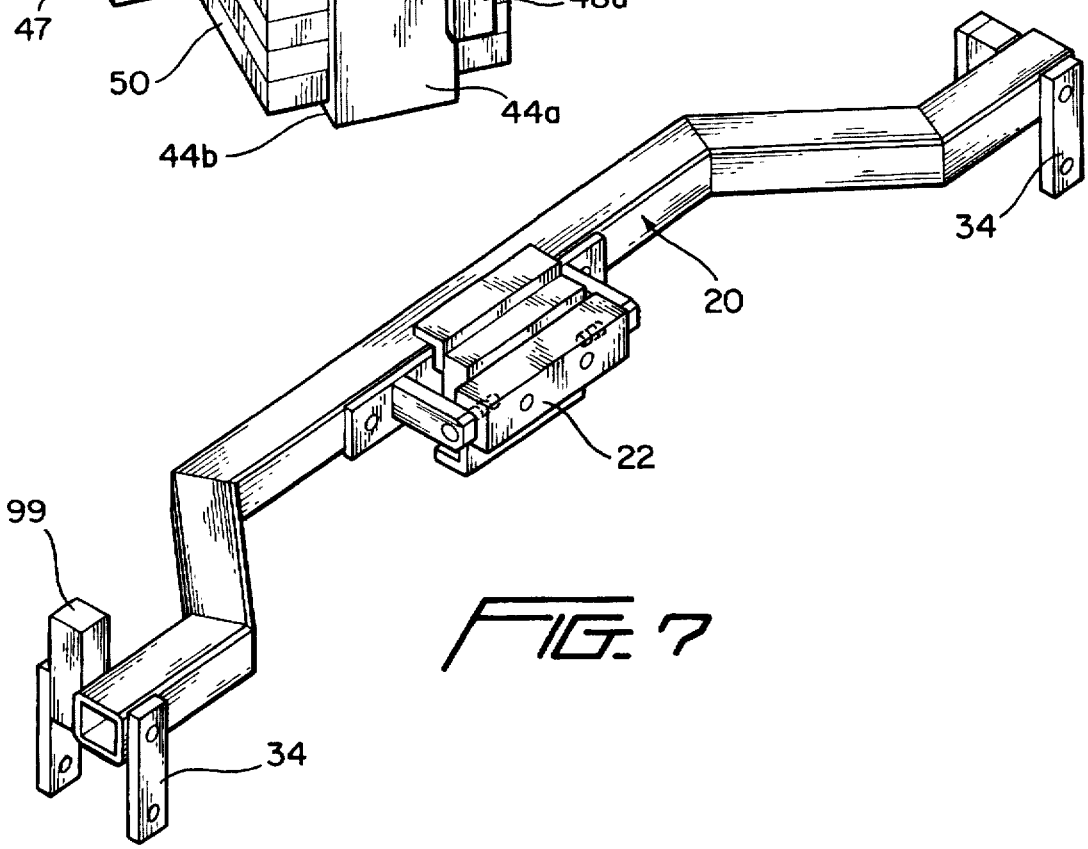
FIG. 7 is a perspective view of a yoke portion of a movement arm included in the machine.

When it is desired to conduct a dynamic exercise of the muscles or to test the dynamic strength of the muscles, the cam 60 is of course released by rotating locking pin 77 to release the cam 60. The user may then apply a force to the movement arm to rotate the movement arm which will be transmitted to the cam 65 through the lock mechanism 82, the latch plate 71 and the strain gauge 72 to thereby rotate the cam about axis 30. This will cause the cam 60 to depress the cam follower 56 and its lever 53 which in turn will cause the connecting link 49 to pivot the weights 50 about the axis 42. The range of movement of the movement arm and in turn the cam 60 during such dynamic exercise or testing may be adjusted to suit the particular user. This is accomplished by releasing the latch plate 70 from the locking pin 80 and moving the movement arm about axis 30 relative to the cam 60 and then re-engaging locking pin 80 in one of the notches 71 of the latch plate 70 to thereby fix the movement arm to the latch plate 70 for rotation together. The rearward movement of the movement arm 20 is limited by means of a stop 99 fixed on one end of the movement arm as shown in FIG. 7 to be engageable with a stop member fixed to the stationary frame 40 when the limit of travel is reached.

Although the present inventions have been shown in conjunction with specific preferred methods and apparatus described above, it will be appreciated by those of ordinary skill in the art that the sent invention may be applied in other forms in accordance with the scope of the claims below.

What is claimed is:

1. Apparatus for exercising and/or testing muscles of the human body, comprising in combination, a movement arm pivotable about an axis and adapted to be engaged by a body part to move the movement arm in one direction, and means opposing movement of the movement arm in said one direction including a weight, means operatively interconnecting the weight and the movement arm to move the weight upon movement of the movement arm in said one direction, said means operatively interconnecting said weight and movement arm including a cam connectible to the movement arm to rotate therewith about said axis, and a cam follower operatively interconnecting the cam and the weight, wherein there is further included means for connecting and disconnecting the cam from the movement arm including a latch means rotatable about said axis of movement of the movement arm, and a locking member mounted on the movement arm for movement between a first position engaging the latch means for interconnecting the latch means and the movement arm and a second position for freeing the movement arm relative to the latch means, and a strain gauge connected to the latch means and connected to the cam for operatively interconnecting the cam and the latch means.

2. The apparatus defined in claim 1 including lock means independent of said latch means for releasably locking the cam against movement.

3. The apparatus defined in claim 1 including a weight carriage holding said weight and having means to hold a plurality of weights, a frame receiving said weight carriage for movement along the frame, means mounting said frame for pivotal movement, and means pivotally connecting the frame to the cam follower to be pivoted by the movement arm.

4. The apparatus defined in claim 3 including a linkage pivotally interconnecting said frame and cam follower.

5. The apparatus defined in claim 4 wherein said cam, cam follower and movement arm are mounted for movement about horizontal axes.

6. The apparatus defined in claim 3 wherein said means of the carriage to hold a plurality of weights includes means for holding a plurality of weights in stacked relationship one on top of the other and wherein said frame is mounted for movement about a pivot axis and wherein there is further included means including guide means for moving said carriage along said frame towards or away from said pivot axis of the frame.

7. Apparatus for exercising and/or testing muscles of the human body, comprising in combination, a movement arm pivotable about an axis and adapted to be engaged by a body part to move the movement arm in one direction, resistance means opposing movement of the movement arm in said one direction, means operatively interconnecting the resistance means and the movement arm including a drive member rotatable about the axis of the movement arm to drive the resistance means upon movement of said movement arm in said one direction, and means including a strain gauge and a latch means interconnecting said drive member and the movement arm to transmit motion from the movement arm to the drive member, and a drive element engaged on the drive member and operatively connected to the resistance means for driving the resistance means in response to movement of the drive member, wherein said latch means includes a latch member, said strain gauge having one end pivotally connected to said latch member.

8. The apparatus defined in claim 7 wherein said latch member is connected to the movement arm to be movable with the movement arm.

9. The apparatus defined in claim 8 wherein said movement arm has a locking member engageable with the latch member to interconnect the movement arm and the latch member.

* * * * *